US007444969B2

(12) United States Patent
Inoue et al.

(10) Patent No.: US 7,444,969 B2
(45) Date of Patent: Nov. 4, 2008

(54) VARIABLE VALVE TIMING APPARATUS

(75) Inventors: Yasumichi Inoue, Toyota (JP); Zenichiro Mashiki, Nisshin (JP); Noboru Takagi, Toyota (JP); Yoshihito Moriya, Nagoya (JP); Haruyuki Urushihata, Chiryu (JP); Akihiko Takenaka, Anjo (JP); Eiji Isobe, Kariya (JP); Takayuki Inohara, Okazaki (JP)

(73) Assignees: Toyota Jidosha Kabushiki Kaisha, Toyota (JP); Denso Corporation, Kariya (JP); Nippon Soken, Inc., Nishio (JP)

( * ) Notice: Subject to any disclaimer, the term of this patent is extended or adjusted under 35 U.S.C. 154(b) by 16 days.

(21) Appl. No.: 11/585,200

(22) Filed: Oct. 24, 2006

(65) Prior Publication Data

US 2007/0125332 A1 Jun. 7, 2007

(30) Foreign Application Priority Data

Dec. 2, 2005 (JP) ..... 2005-349129

(51) Int. Cl.
*F01L 1/34* (2006.01)

(52) U.S. Cl. ..... 123/90.17; 123/90.15; 123/90.16; 123/90.31

(58) Field of Classification Search ..... 123/90.17
See application file for complete search history.

(56) References Cited

U.S. PATENT DOCUMENTS 5,080,053 A 1/1992 Parsons
5,992,361 A 11/1999 Murata et al.
6,883,482 B2 * 4/2005 Takenaka et al. ..... 123/90.17
6,920,855 B2 * 7/2005 Takenaka et al. ..... 123/90.17
2001/0006050 A1 7/2001 Heer

FOREIGN PATENT DOCUMENTS

| | | |
|---|---|---|
| EP | 0 428 278 A1 | 5/1991 |
| JP | A 2005-48707 | 2/2005 |
| JP | A 2005-98142 | 4/2005 |
| WO | WO 2006/038370 A1 | 4/2006 |

* cited by examiner

*Primary Examiner*—Thomas Denion
*Assistant Examiner*—Kyle M Riddle
(74) *Attorney, Agent, or Firm*—Oliff & Berridge, PLC

(57) ABSTRACT

In the case where an intake valve has its phase in a first region between a most retarded angle and CA(1), the rotational speed of relative rotation between an output shaft of an electric motor and a sprocket is reduced at a reduction gear ratio R(1) to change the phase of the intake valve. In the case where the intake valve has its phase in a second region between CA(2) and a most advanced angle, the rotational speed of relative rotation is reduced at a reduction gear ratio R(2) to change the phase of the intake valve. As long as the rotational direction of relative rotation is the same, the phase of the intake valve is changed in the same direction for both of the first region between the most retarded angle and CA(1) and the second region between CA(2) and the most advanced angle.

8 Claims, 9 Drawing Sheets

VARIABLE VALVE TIMING APPARATUS

This nonprovisional application is based on Japanese Patent Application No. 2005-349129 filed with the Japan Patent Office on Dec. 2, 2005, the entire contents of which are hereby incorporated by reference.

BACKGROUND OF THE INVENTION

1. Field of the Invention

The present invention relates to a variable valve timing apparatus. In particular, the invention relates to a variable valve timing apparatus that varies the timing at which a valve is opened/closed by a variation amount according to an operation amount of an actuator.

2. Description of the Background Art

VVT (Variable Valve Timing) has conventionally been known that changes the phase (crank angle) in (at) which an intake valve or an exhaust valve is opened/closed, according to an operating condition. Generally, the VVT changes the phase by rotating, relative to a sprocket or the like, a camshaft that causes the intake valve or exhaust valve to open/close. The camshaft is rotated by such an actuator as hydraulic or electric motor. Particularly, in the case where the electric motor is used to rotate the camshaft, the torque for rotating the camshaft is difficult to obtain, as compared with the case where the camshaft is hydraulically rotated. Therefore, in the case where the electric motor is used to rotate the camshaft, the torque of the electric motor is transmitted via a link mechanism or the like to the camshaft, thereby rotating the camshaft. However, in the case where the link mechanism or the like is operated to adjust the opening/closing timing, the operation of the actuator is changed in speed (decelerated or accelerated) by the link mechanism or the like to be transmitted to the camshaft. Therefore, in order to accurately control the variable timing, it is desirable that a variation amount by which the opening/closing timing of the valve is varied is proportional to an operation amount or the like of the actuator by which the actuator operates.

Japanese Patent Laying-Open No. 2005-048707 discloses a valve timing adjusting apparatus that adjusts the rotational phase (valve opening/closing timing) of a driven shaft (camshaft) with respect to a driving shaft (crankshaft), in proportion to the rotational phase of a guide member rotated by an actuator. The valve timing adjusting apparatus disclosed in Japanese Patent Laying-Open No. 2005-048707 is provided in a transmission system that transmits a driving torque of the driving shaft (crankshaft) to the driven shaft (camshaft) that drives to open/close at least one of the intake valve and the exhaust valve of an internal combustion engine, and the adjusting apparatus adjusts the opening/closing timing of at least one of the valves. The valve timing adjusting apparatus includes: a phase change mechanism that has a first rotation member rotating in synchronization with the driving shaft and a second rotation member rotating in synchronization with the driven shaft, and that converts motion of a member to be controlled into relative rotating motion of the second rotation member with respect to the first rotation member so as to change the rotational phase of the driven shaft with respect to the driving shaft; and a guide member that is relatively rotated with respect to the first rotation member by transmission of a control torque from the actuator so as to guide a movable body in the direction in which a guide path is extended. The movable body slides in the guide-path-extending direction with respect to the guide member while moving the member to be controlled and accordingly, the rotational phase of the second rotation member with respect to the first rotation member is varied in proportion to the rotational phase of the guide member with respect to the first rotation member.

By means of the valve timing adjusting apparatus disclosed in the above-referenced publication, the movable body relatively slides in the guide-path-extending direction with respect to the guide member while moving the member to be controlled, and thus the rotational phase of the second rotation member with respect to the first rotation member is varied in proportion to the rotational phase of the guide member with respect to the first rotation member. Thus, the rotational phase of the guide member with respect to the first rotation member may be controlled to accurately adjust the rotational phase of the second rotation member with respect to the first rotation member, namely the rotational phase of the driven shaft with respect to the driving shaft.

However, in the case where the variation amount of the opening/closing timing is changed in proportion to the operation amount or the like of the actuator as done by the valve timing adjusting apparatus disclosed in Japanese Patent Laying-Open No. 2005-048707, if the slope of the proportionality is smaller (if the gear ratio of the VVT is higher), a range over which the opening/closing timing can be changed is smaller. On the contrary, in the case where the slope is larger (the gear ratio of the VVT is lower), if the actuator is stopped (in the state where no torque is generated), operation of the engine generates a torque acting on the camshaft and thereby drives the actuator. In this case, the opening/closing timing is changed, and the valve opening/closing timing cannot be kept as controlled.

SUMMARY OF THE INVENTION

An object of the present invention is to provide a variable valve timing apparatus that can change the valve opening and closing timing over a wide range and that can keep the valve opening and closing timing at a timing precisely as controlled.

A variable valve timing apparatus according to the present invention changes opening and closing timing of at least one of an intake valve and an exhaust valve. The variable valve timing apparatus includes: an actuator; and a change mechanism changing the opening and closing timing by a variation amount according to an operation amount of the actuator. The change mechanism changes the opening and closing timing so that a ratio between the operation amount of the actuator and the variation amount of the opening and closing timing is different, and direction of change of the opening and closing timing is identical, between a case where the opening and closing timing is in a first region and a case where the opening and closing timing is in a second region.

In accordance with the present invention, the opening and closing timing is changed so that the ratio between the operation amount of the actuator and the variation amount of the opening and closing timing is different between the case where the opening and closing timing is in the first region and the case where the opening and closing timing is in the second region, and so that the direction of change of the opening and closing timing is identical between these cases. Thus, for example, while the opening and closing timing can be advanced for both regions, the degree to which the timing is advanced can be made larger for one of the regions advanced with respect to other regions. Alternatively, for example, while the opening and closing timing can be retarded for both regions, the degree to which the timing is retarded can be made larger for one of the regions advanced with respect to other regions. In this way, the range over which the opening and closing timing can be changed can be increased. Further, for a region where the variation amount of the opening and closing timing is small, even if a torque output from the actuator is small, the opening and closing timing can be changed. However, in this case, a large torque is necessary for driving the actuator by changing the opening and closing timing. Therefore, for this region, even in the state where the actuator generates no torque, the actuator can be restrained from being driven by a torque acting on the camshaft as the engine is operated. Thus, a change of the actual opening and closing timing from an opening and closing timing determined under control can be restrained. Accordingly, the variable valve timing apparatus can be provided that can change the opening and closing timing over a wide range and that can keep the valve opening and closing timing at a timing as controlled.

Preferably, the change mechanism changes the opening and closing timing so that the ratio between the operation amount of the actuator and the variation amount of the opening and closing timing changes at a predetermined rate of change in a case where the opening and closing timing is between the first region and the second region, in addition to changing the opening and closing timing so that the ratio between the operation amount of the actuator and the variation amount of the opening and closing timing is different and direction of change of the opening and closing timing is identical between the case where the opening and closing timing is in the first region and the case where the opening and closing timing is in the second region.

In accordance with the present invention, in the case where the opening and closing timing is in a region between the first region and the second region, the opening and closing timing is changed so that the ratio between the operation amount of the actuator and the variation amount of the opening and closing timing changes at a predetermined rate of change. Thus, in the case where the opening and closing timing changes from the first region to the second region or from the second region to the first region, the variation amount of the opening and closing timing relative to the operation amount of the actuator can be gradually increased or decreased. Therefore, a sudden stepwise change of the variation amount of the opening and closing timing can be restrained and thus a sudden change of the opening and closing timing can be restrained. Accordingly, the capability to control the opening and closing timing can be improved.

Still preferably, the second region is a region advanced with respect to the first region. The change mechanism changes the opening and closing timing so that the variation amount of the opening and closing timing is larger for the second region than the variation amount for the first region.

In accordance with the present invention, the opening and closing timing is changed so that the variation amount of the opening and closing timing is larger for the region advanced with respect to other regions. Thus, the range over which the opening and closing timing can be changed can be increased. Further, for the region retarded with respect to other regions (region where the variation amount of the opening and closing timing is smaller), the opening and closing timing can be changed even when the torque output from the actuator is small, while a large torque is necessary to drive the actuator by changing the opening and closing timing. Therefore, for this region, even in the state where the actuator generates no torque, actuator can be restrained from being driven by the torque acting on the camshaft as the engine is operated for example. Thus, a change of the actual opening and closing timing from an opening and closing timing determined under control can be restrained. Accordingly, the opening and closing timing can be changed over a wide range and the valve opening and closing timing can be kept at a timing as controlled.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
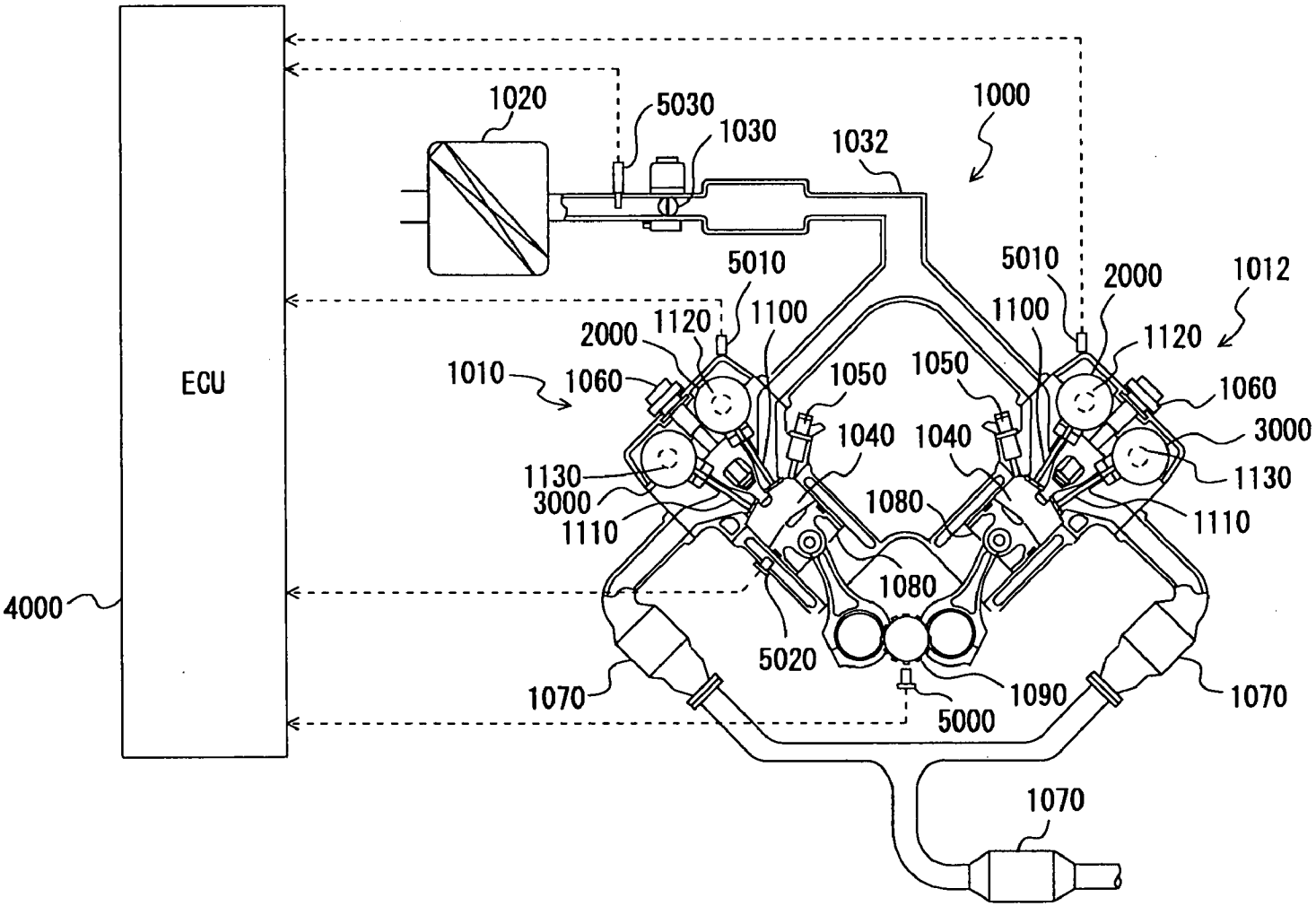
FIG. 1 is a schematic showing a configuration of an engine of a vehicle on which a variable valve timing apparatus is mounted according to an embodiment of the present invention.

With reference to the drawings, embodiments of the present invention are hereinafter described. In the following description, like components are denoted by like reference characters. They are also named identically and function identically. Therefore, a detailed description thereof is not repeated.

Referring to FIG. 1, a description is given of an engine of a vehicle on which a variable valve timing apparatus is mounted, according to an embodiment of the present invention.

An engine 1000 is a V-type 8-cylinder engine having an "A" bank 1010 and a "B" bank 1012 each including a group of four cylinders. Here, any engine other than the V8 engine may be used.

Into engine 1000, air is sucked from an air cleaner 1020. The quantity of sucked air is adjusted by a throttle valve 1030. Throttle valve 1030 is an electronic throttle valve driven by a motor.

The air is supplied through an intake manifold 1032 into a cylinder 1040. The air is mixed with fuel in cylinder 1040 (combustion chamber). Into cylinder 1040, the fuel is directly injected from an injector 1050. In other words, injection holes of injector 1050 are provided within cylinder 1040.

The fuel is injected in the intake stroke. The fuel injection timing is not limited to the intake stroke. Further, in the present embodiment, engine 1000 is described as a direct-injection engine having injection holes of injector 1050 that are disposed within cylinder 1040. However, in addition to direct-injection (in-cylinder) injector 1050, a port injector may be provided. Moreover, only the port injector may be provided.

The air-fuel mixture in cylinder 1040 is ignited by a spark plug 1060 and accordingly burned. The air-fuel mixture after burned, namely exhaust gas, is cleaned by a three-way catalyst 1070 and thereafter discharged to the outside of the vehicle. The air-fuel mixture is burned to press down a piston 1080 and thereby rotate a crankshaft 1090.

At the top of cylinder 1040, an intake valve 1100 and an exhaust valve 1110 are provided. Intake valve 1100 is driven by an intake camshaft 1120. Exhaust valve 1110 is driven by an exhaust camshaft 1130. Intake camshaft 1120 and exhaust camshaft 1130 are coupled by such parts as a chain and gears to be rotated at the same rotational speed.

Intake valve 1100 has its phase (opening/closing timing) controlled by an intake VVT mechanism 2000 provided to intake camshaft 1120. Exhaust valve 1110 has its phase (opening/closing timing) controlled by an exhaust VVT mechanism 3000 provided to exhaust camshaft 1130.

In the present embodiment, intake camshaft 1120 and exhaust camshaft 1130 are rotated by the VVT mechanisms to control respective phases of intake valve 1100 and exhaust valve 1110. Here, the phase control method is not limited to the aforementioned one.

Intake VVT mechanism 2000 is operated by an electric motor 2060 (not shown in FIG. 1). Electric motor 2060 is controlled by an ECU (Electronic Control Unit) 4000. The current and voltage of electric motor 2060 are detected by an ammeter (not shown) and a voltmeter (not shown) and the measurements are input to ECU 4000.

Exhaust VVT mechanism 3000 is hydraulically operated. Here, intake VVT mechanism 2000 may be hydraulically operated while exhaust VVT mechanism 3000 may be operated by an electric motor.

To ECU 4000, signals indicating the rotational speed and the crank angle of crankshaft 1090 are input from a crank angle sensor 5000. Further, to ECU 4000, signals indicating respective phases of intake camshaft 1120 and exhaust camshaft 1130 (phase: the camshaft position in the rotational direction) are input from a cam position sensor 5010.

Furthermore, to ECU 4000, a signal indicating the water temperature (coolant temperature) of engine 1000 from a coolant temperature sensor 5020 as well as a signal indicating the quantity of intake air (quantity of air taken or sucked into engine 1000) of engine 1000 from an airflow meter 5030 are input.

Based on these signals input from the sensors as well as a map and a program stored in a memory (not shown), ECU 4000 controls the throttle opening position, the ignition timing, the fuel injection timing, the quantity of injected fuel, the phase of intake valve 1100 and the phase of exhaust valve 1110 for example, so that engine 1000 is operated in a desired operating state.

Figure 2:
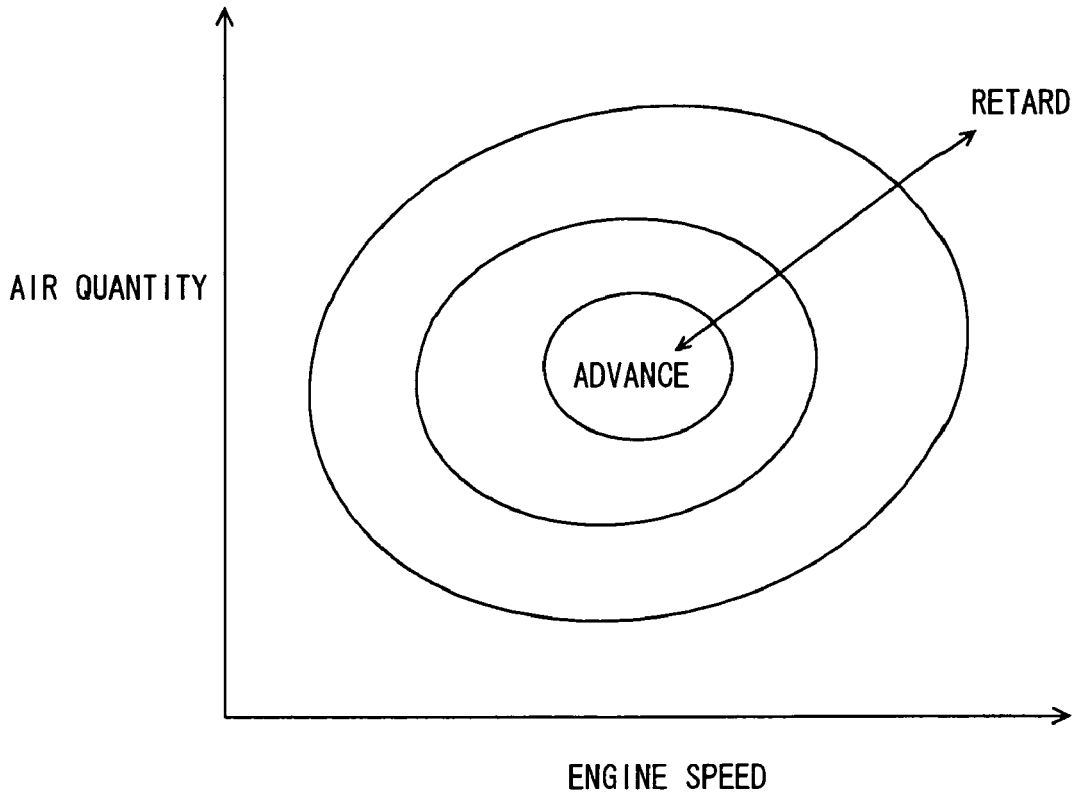
FIG. 2 shows a map defining the phase of an intake camshaft.

In the present embodiment, ECU 4000 determines the phase of intake valve 1100 based on the map as shown in FIG. 2 that uses the engine speed NE and the intake air quantity KL as parameters. A plurality of maps for respective coolant temperatures are stored for determining the phase of intake valve 1100.

In the following, a further description is given of intake VVT mechanism 2000. Here, exhaust VVT mechanism 3000 may be configured identically to intake VVT mechanism 2000 as described below.

Figure 3:
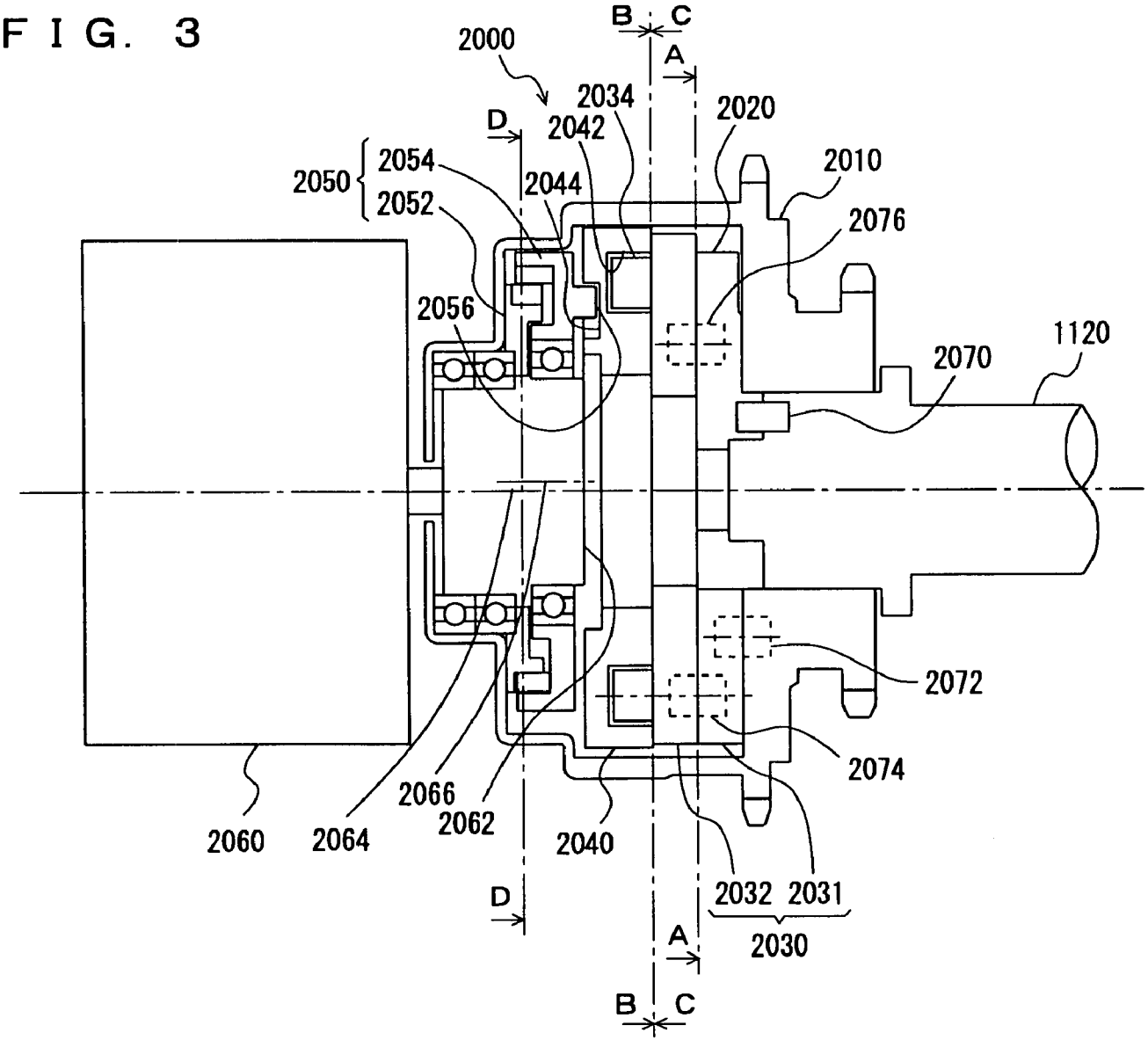
FIG. 3 is a cross section showing an intake VVT mechanism.

As shown in FIG. 3, intake VVT mechanism 2000 is comprised of a sprocket 2010, a cam plate 2020, a link mechanism 2030, a guide plate 2040, a speed reducer 2050, and electric motor 2060.

Sprocket 2010 is coupled via a chain or the like to crankshaft 1090. The rotational speed of sprocket 2010 is half the rotational speed of crankshaft 1090. Intake camshaft 1120 is provided concentrically with the rotational axis of sprocket 2010 and rotatably relative to sprocket 2010.

Cam plate 2020 is coupled to intake camshaft 1120 with a pin (1) 2070. Cam plate 2020 rotates, on the inside of sprocket 2010, together with intake camshaft 1120. Here, cam plate 2020 and intake camshaft 1120 may be integrated into one unit.

Figure 4:
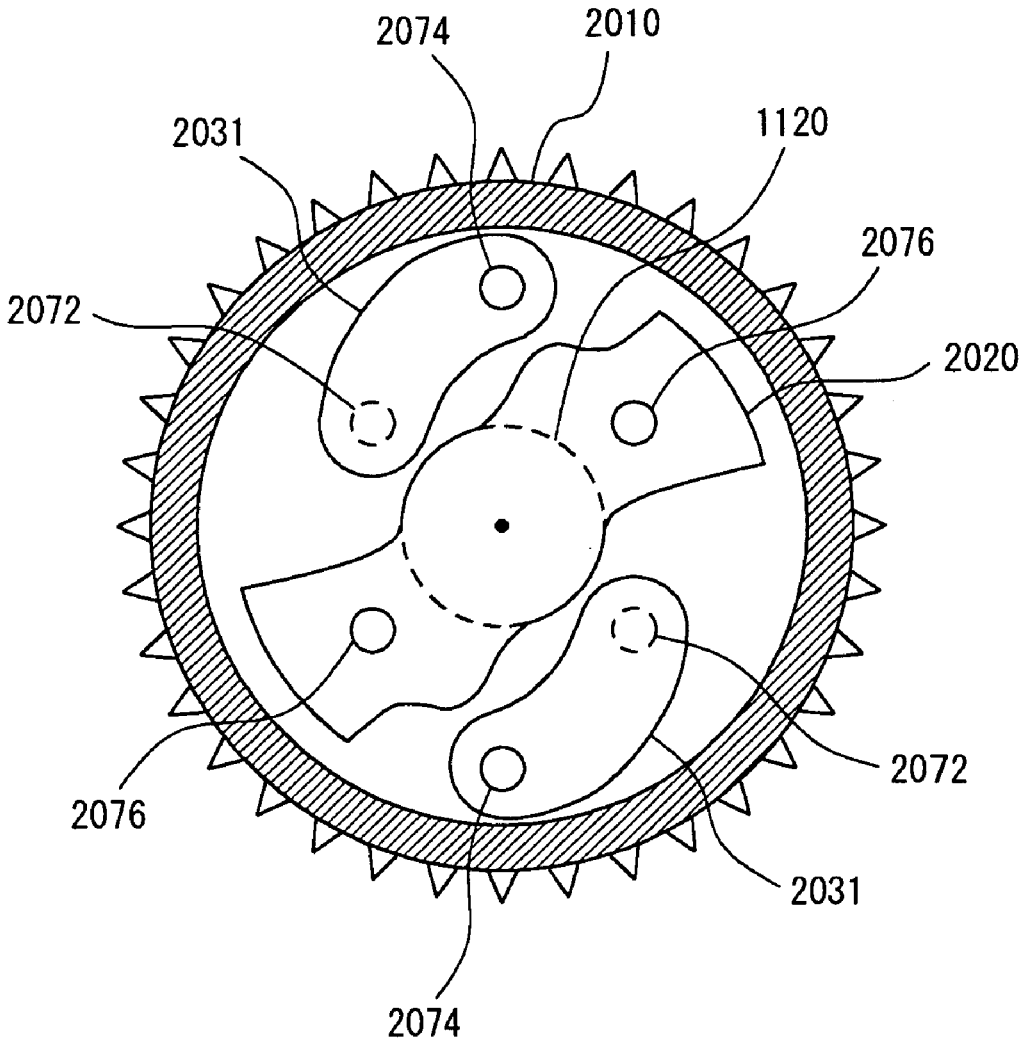
FIG. 4 is a cross section along A-A in FIG. 3.

Link mechanism 2030 is comprised of an arm (1) 2031 and an arm (2) 2032. As shown in FIG. 4 which is a cross section along A-A in FIG. 3, a pair of arms (1) 2031 is provided within sprocket 2010 so that the arms are point symmetric to each other with respect to the rotational axis of intake camshaft 1120. Each arm (1) 2031 is coupled to sprocket 2010 so that the arm can swing about a pin (2) 2072.

Figure 5:
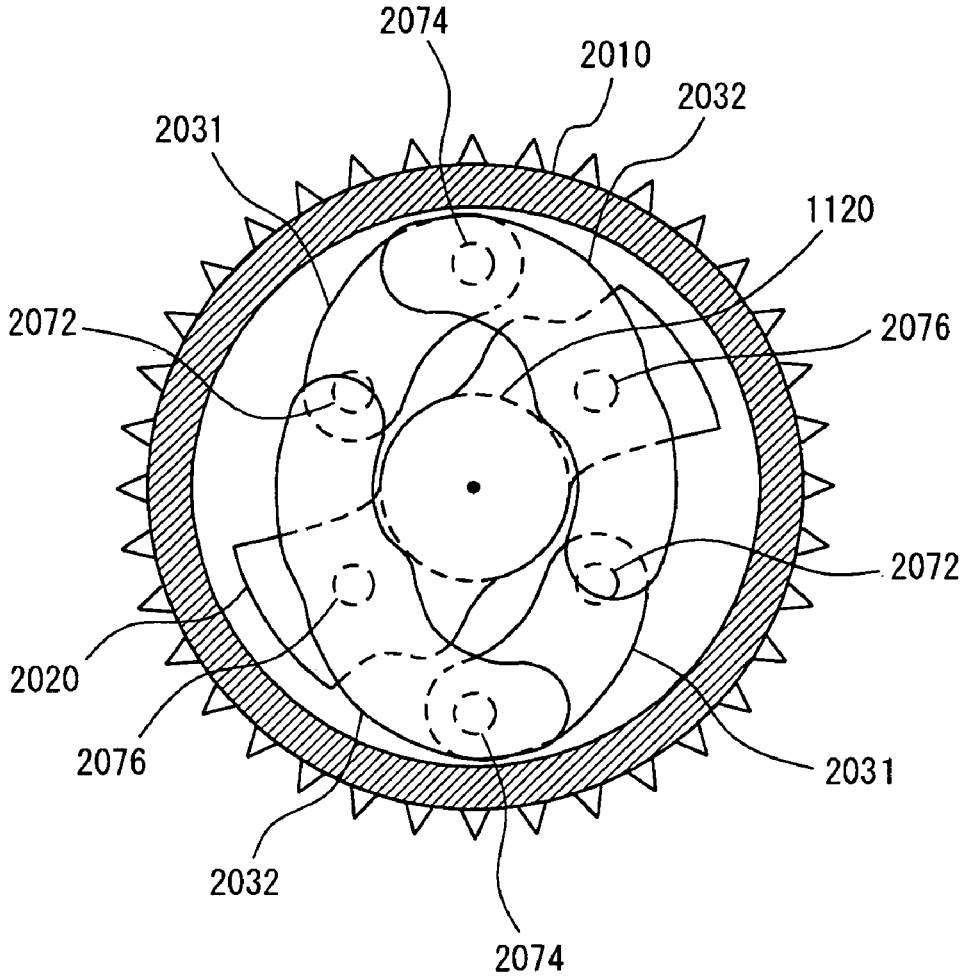
FIG. 5 is a (first) cross section along B-B in FIG. 3.
Figure 6:
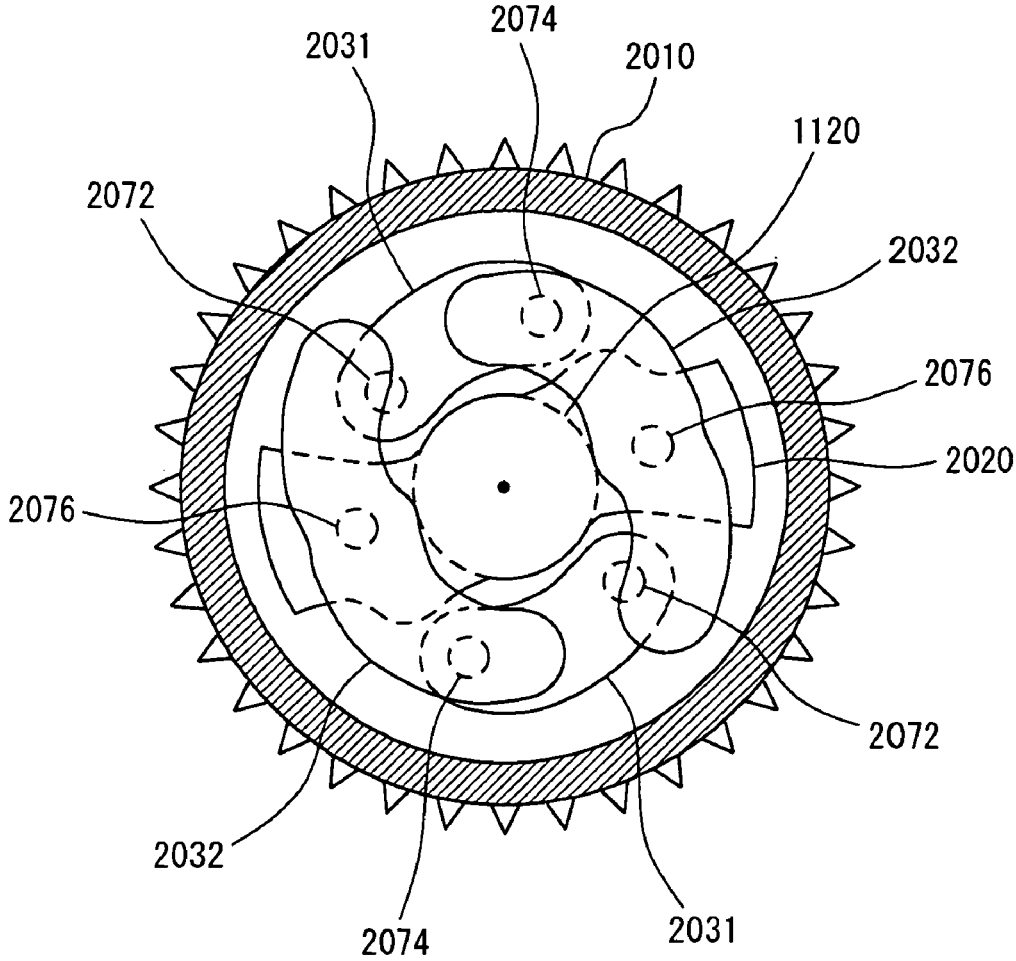
FIG. 6 is a (second) cross section along B-B in FIG. 3.

As shown in FIG. 5 which is a cross section along B-B in FIG. 3 and as shown in FIG. 6 showing the state where the phase of intake valve 1100 is advanced with respect to the state in FIG. 5, arms (1) 2031 and cam plate 2020 are coupled by arms (2) 2032.

Arm (2) 2032 is supported so that the arm can swing about a pin (3) 2074 and with respect to arm (1) 2031. Further, arm (2) 2032 is supported so that the arm can swing about a pin (4) 2076 and with respect to cam plate 2020.

A pair of link mechanisms 2030 causes intake camshaft 1120 to rotate relative to sprocket 2010 and thereby changes the phase of intake valve 1100. Thus, even if one of the paired link mechanisms 2030 is broken as a result of any damage or the like, the other link mechanism can be used to change the phase of intake valve 1100.

Referring back to FIG. 3, at a surface of each link mechanism 2030 (arm (2) 2032) that is a surface thereof facing guide plate 2040, a control pin 2034 is provided. Control pin 2034 is provided concentrically with pin (3) 2074. Each control pin 2034 slides in a guide groove 2042 provided in guide plate 2040.

Each control pin 2034 slides in guide groove 2042 of guide plate 2040 to shift in the radial direction. The radial shift of each control pin 2034 causes intake camshaft 1120 to rotate relative to sprocket 2010.

Figure 7:
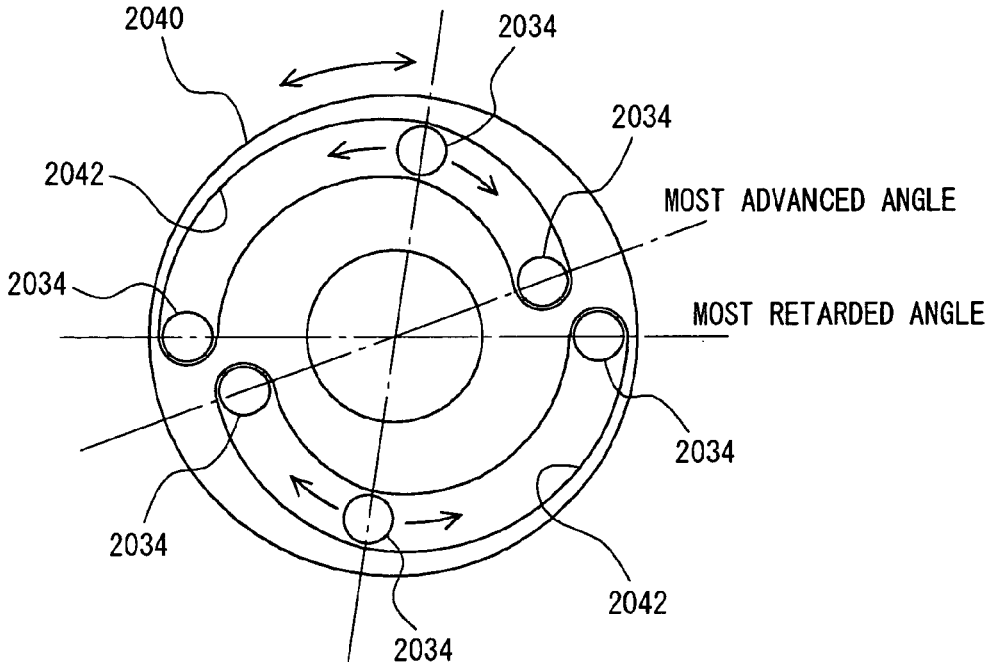
FIG. 7 is a cross section along C-C in FIG. 3.

As shown in FIG. 7 which is a cross section along C-C in FIG. 3, guide groove 2042 is formed in the spiral shape so that rotation of guide plate 2040 causes each control pin 2034 to shift in the radial direction. Here, the shape of guide groove 2042 is not limited to this.

As control pin 2034 is shifted further in the radial direction from the axial center of guide plate 2040, the phase of intake valve 1100 is retarded to a greater extent. In other words, the variation amount of the phase has a value corresponding to the operation amount of link mechanism 2030 generated by the radial shift of control pin 2034. Alternatively, the phase of intake valve 1100 may be advanced to a greater extent as control pin 2034 is shifted further in the radial direction from the axial center of guide plate 2040.

As shown in FIG. 7, when control pin 2034 abuts on an end of guide groove 2042, the operation of link mechanism 2030 is restrained. Therefore, the phase in which control pin 2034 abuts on an end of guide groove 2042 is the phase of the most retarded angle or the most advanced angle.

Referring back to FIG. 3, in guide plate 2040, a plurality of depressed portions 2044 are provided in its surface facing speed reducer 2050, for coupling guide plate 2040 and speed reducer 2050 to each other.

Speed reducer 2050 is comprised of an outer teeth gear 2052 and an inner teeth gear 2054. Outer teeth gear 2052 is fixed with respect to sprocket 2010 so that the gear rotates together with sprocket 2010.

Inner teeth gear 2054 has a plurality of protruded portions 2056 thereon that are received in depressed portions 2044 of guide plate 2040. Inner teeth gear 2054 is supported rotatably about an eccentric axis 2066 of a coupling 2062 formed eccentrically with respect to an axial center 2064 of an output shaft of electric motor 2060.

Figure 8:
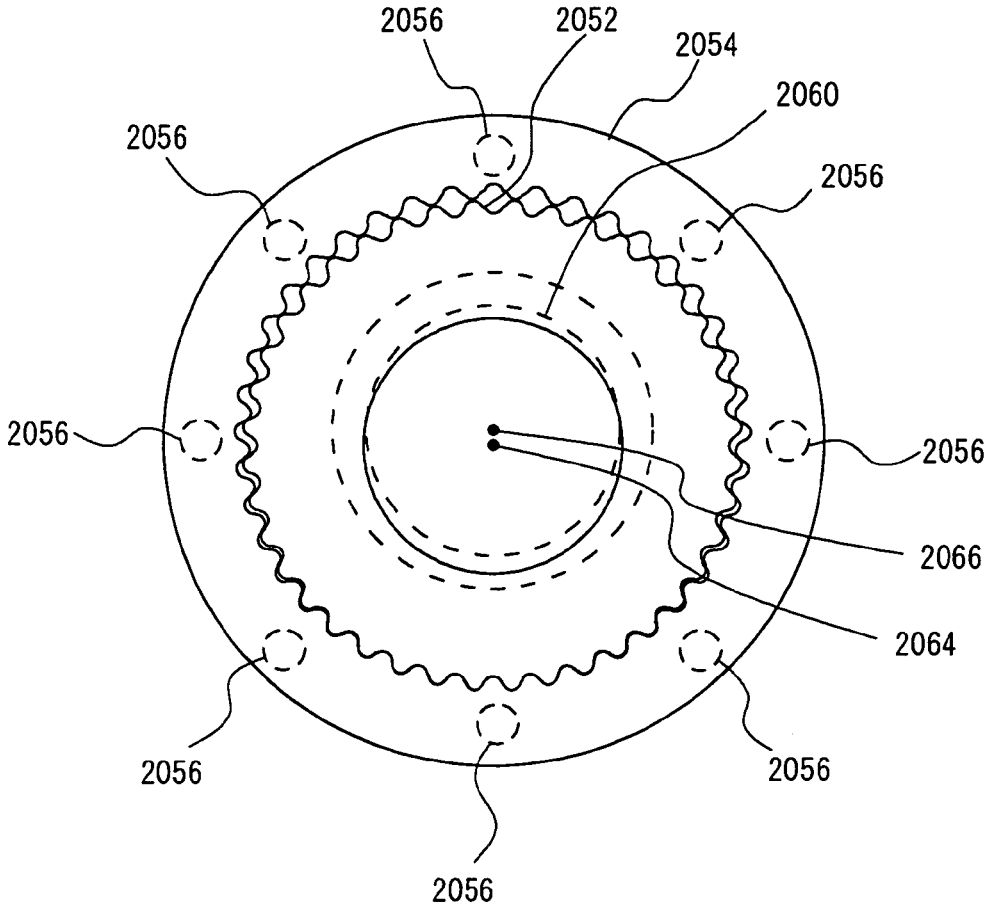
FIG. 8 is a cross section along D-D in FIG. 3.

FIG. 8 shows a cross section along D-D in FIG. 3. Inner teeth gear 2054 is provided so that a part of the teeth thereof meshes with outer teeth gear 2052. In the case where the rotational speed of the output shaft of electric motor 2060 is identical to the rotational speed of sprocket 2010, coupling 2062 and inner teeth gear 2054 rotate at the same rotational speed as that of outer teeth gear 2052 (sprocket 2010). In this case, guide plate 2040 rotates at the same rotational speed as that of sprocket 2010 and accordingly the phase of intake valve 1100 is maintained.

When electric motor 2060 causes coupling 2062 to rotate about axial center 2064 and relative to outer teeth gear 2052, accordingly inner teeth gear 2054 as a whole revolves about axial center 2064 while inner teeth gear 2054 rotates about eccentric axis 2066. The rotational motion of inner teeth gear 2054 causes guide plate 2040 to rotate relative to sprocket 2010 and thus the phase of intake valve 1100 is changed.

The phase of intake valve 1100 is changed by reduction of the rotational speed of relative rotation between the output shaft of electric motor 2060 and sprocket 2010 (operation amount of electric motor 2060) by speed reducer 2050, guide plate 2040 and link mechanism 2030. Here, the rotational speed of relative rotation between the output shaft of electric motor 2060 and sprocket 2010 may be increased to change the phase of intake valve 1100.

Figure 9:
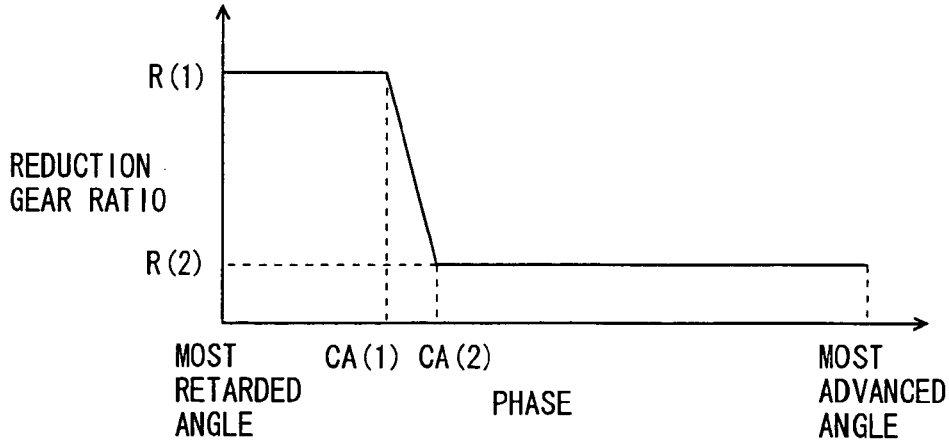
FIG. 9 shows the reduction gear ratio of the intake VVT mechanism as a whole.

As shown in FIG. 9, the reduction gear ratio of intake VVT mechanism 2000 as a whole (the ratio of the rotational speed of relative rotation between the output shaft of electric motor 2060 and sprocket 2010 to the variation amount of the phase) may have a value according to the phase of intake valve 1100. In the present embodiment, as the reduction gear ratio is higher, the variation amount of the phase with respect to the rotational speed of relative rotation between the output shaft of electric motor 2060 and sprocket 2010 is smaller.

In the case where the phase of intake valve 1100 is in a first region from the most retarded angle to CA (1), the reduction gear ratio of intake VVT mechanism 2000 as a whole is R (1). In the case where the phase of intake valve 1100 is in a second region from CA (2) (CA (2) is advanced with respect to CA (1)) to the most advanced angle, the reduction gear ratio of intake VVT mechanism 2000 as a whole is R (2) (R (1)>R (2)).

In the case where the phase of intake valve 1100 is in a third region from CA (1) to CA (2), the reduction gear ratio of intake VVT mechanism 2000 as a whole changes at a predetermined rate of change ((R (2)−R (1))/(CA (2)−CA (1)).

Based on the configuration as described above, intake VVT mechanism 2000 of the variable valve timing apparatus in the present embodiment functions as described below.

Figure 10:
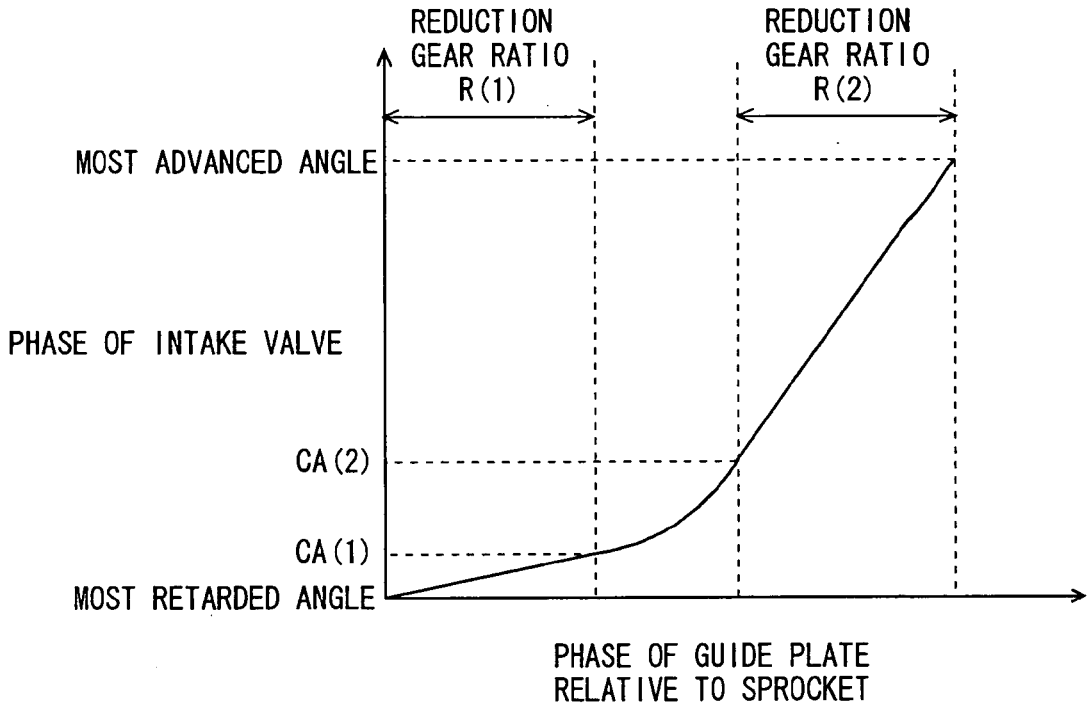
FIG. 10 shows a relation between the phase of a guide plate relative to a sprocket and the phase of an intake camshaft.

In the case where the phase of intake valve 1100 (intake camshaft 1120) is to be advanced, electric motor 2060 is operated to rotate guide plate 2040 relative to sprocket 2010, thereby advancing the phase of intake valve 1100 as shown in FIG. 10.

In the case where the phase of intake valve 1100 is in the first region between the most retarded angle and CA (1), the rotational speed of relative rotation between the output shaft of electric motor 2060 and sprocket 2010 is reduced at reduction gear ratio R (1) to advance the phase of intake valve 1100.

In the case where the phase of intake valve 1100 is in the second region between CA (2) and the most advanced angle, the rotational speed of relative rotation between the output shaft of electric motor 2060 and sprocket 2010 is reduced at reduction gear ratio R (2) to advance the phase of intake valve 1100.

In the case where the phase of intake valve 1100 is to be retarded, the output shaft of electric motor 2060 is rotated relative to sprocket 2010 in the direction opposite to the direction in the case where the phase thereof is to be advanced. In the case where the phase is to be retarded, similarly to the case where the phase is to be advanced, when the phase of intake valve 1100 is in the first region between the most retarded angle and CA (1), the rotational speed of relative rotation between the output shaft of electric motor 2060 and sprocket 2010 is reduced at reduction gear ratio R (1) to retard the phase. Further, when the phase of intake valve 1100 is in the second region between CA (2) and the most advanced angle, the rotational speed of relative rotation between the output shaft of electric motor 2060 and sprocket 2010 is reduced at reduction gear ratio R (2) to retard the phase.

Accordingly, as long as the direction of the relative rotation between the output shaft of electric motor 2060 and sprocket 2010 is the same, the phase of intake valve 1100 can be advanced or retarded for both of the first region between the most retarded angle and CA (1) and the second region between CA (2) and the most advanced angle. Here, for the second region between CA (2) and the most advanced angle, the phase can be more advanced or more retarded. Thus, the phase can be changed over a wide range.

Further, since the reduction gear ratio is high for the first region between the most retarded angle and CA (1), a large torque is necessary for rotating the output shaft of electric motor 2060 by a torque acting on intake camshaft 1120 as engine 1000 operates. Therefore, in the case where electric motor 2060 is stopped for example, even if electric motor 2060 generates no torque, rotation can be restrained of the output shaft of electric motor 2060 caused by the torque acting on intake camshaft 1120. Therefore, a change of the actual phase from a phase determined under control can be restrained.

In the chase where the phase of intake valve 1100 is in the third region between CA (1) and CA (2), the rotational speed of relative rotation between the output shaft of electric motor 2060 and sprocket 2010 is reduced at a reduction gear ratio that changes at a predetermined rate of change, which may result in advance or retard in phase of intake valve 1100.

Accordingly, in the case where the phase changes from the first region to the second region or from the second region to the first region, the variation amount of the phase with respect to the rotational speed of relative rotation between the output shaft of electric motor 2060 and sprocket 2010 can be increased or decreased gradually. In this way, a sudden stepwise change of the variation amount of the phase can be restrained to thereby restrain a sudden change in phase. Accordingly, the capability to control the phase can be improved.

As discussed above, the intake VVT mechanism for the variable valve timing apparatus in the present embodiment provides, in the case where the phase of the intake valve is in the region from the most retarded angle to CA (1), reduction gear ratio R (1) of intake VVT mechanism 2000 as a whole. In the case where the phase of the intake valve is in the region from CA (2) to the most advanced angle, the reduction gear ratio of intake VVT mechanism 2000 as a whole is R (2) which is lower than R (1). Thus, as long as the rotational direction of the output shaft of the electric motor is the same, the phase of the intake valve can be advanced or retarded for both of the regions, namely the first region between the most retarded angle and CA (1) and the second region between CA (2) and the most advanced angle. Here, for the second region between CA (2) and the most advanced angle, the phase can be advanced or retarded to a greater extent. Therefore, the phase can be changed over a wide range. Further, for the first region between the most retarded angle and CA (1), the reduction gear ratio is high and therefore, rotation can be restrained of the output shaft of the electric motor by the torque acting on the intake camshaft as the engine is operated. Thus, a change of the actual phase from a phase determined under control can be restrained. Accordingly, the phase can be changed over a wide range and the phase can be controlled accurately.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A variable valve timing apparatus changing opening and closing timing of at least one of an intake valve and an exhaust valve, comprising:

an actuator; and a change mechanism changing said opening and closing timing by a variation amount according to an operation amount of said actuator, said change mechanism changing said opening and closing timing so that a ratio between the operation amount of said actuator and the variation amount of said opening and closing timing is different, and direction of change of said opening and closing timing is identical, between a case where said opening and closing timing is in a first region and a case where said opening and closing timing is in a second region, and changing said opening and closing timing at a constant ratio with respect to the operation amount of said actuator in a case where said opening and closing timing is in said first region and a case where said opening and closing timing is in said second region.

2. The variable valve timing apparatus according to claim 1, wherein said change mechanism changes said opening and closing timing so that the ratio between the operation amount of said actuator and the variation amount of said opening and closing timing changes at a predetermined rate of change in a case where said opening and closing timing is between said first region and said second region, in addition to changing said opening and closing timing so that the ratio between the operation amount of said actuator and the variation amount of said opening and closing timing is different and direction of change of said opening and closing timing is identical between the case where said opening and closing timing is in the first region and the case where said opening and closing timing is in the second region, as well as changing said opening and closing timing at a constant ratio with respect to the operation amount of said actuator in the case where said opening and closing timing is in said first region and a case where said opening and closing timing is in said second region.

3. The variable valve timing apparatus according to claim 2, wherein said second region is a region advanced with respect to said first region, and said change mechanism changes said opening and closing timing so that the variation amount of said opening and closing timing is larger for said second region than the variation amount for said first region.

4. The variable valve timing apparatus according to claim 1, wherein said second region is a region advanced with respect to said first region, and said change mechanism changes said opening and closing timing so that the variation amount of said opening and closing timing is larger for said second region than the variation amount for said first region.

5. A variable valve timing apparatus changing opening and closing timing of at least one of an intake valve and an exhaust valve, comprising:

an actuator; and a change mechanism changing said opening and closing timing by a variation amount according to an operation amount of said actuator, said change mechanism changing said opening and closing timing so that a ratio between the operation amount of said actuator and the variation amount of said opening and closing timing is different, and direction of change of said opening and closing timing is identical, between a case where said opening and closing timing is in a first region and a case where said opening and closing timing is in a second region, and restraining the change of said opening and closing timing in a case where said opening and closing timing is in said first region while said actuator is stopped.

6. The variable valve timing apparatus according to claim 5, wherein said change mechanism changes said opening and closing timing so that the ratio between the operation amount of said actuator and the variation amount of said opening and closing timing changes at a predetermined rate of change in a case where said opening and closing timing is between said first region and said second region, in addition to changing said opening and closing timing so that the ratio between the operation amount of said actuator and the variation amount of said opening and closing timing is different and direction of change of said opening and closing timing is identical between the case where said opening and closing timing is in the first region and the case where said opening and closing timing is in the second region, as well as restraining the change of said opening and closing timing in the case where said opening and closing timing is in said first region while said actuator is stopped.

7. The variable valve timing apparatus according to claim 6, wherein said second region is a region advanced with respect to said first region, and said change mechanism changes said opening and closing timing so that the variation amount of said opening and closing timing is larger for said second region than the variation amount for said first region.

8. The variable valve timing apparatus according to claim 5, wherein said second region is a region advanced with respect to said first region, and said change mechanism changes said opening and closing timing so that the variation amount of said opening and closing timing is larger for said second region than the variation amount for said first region.

* * * * *